United States Patent [19]

Rechlicz et al.

[11] 4,065,534

[45] Dec. 27, 1977

[54] METHOD OF PROVIDING A RESIN REINFORCED ASBESTOS DIAPHRAGM

[75] Inventors: Thomas A. Rechlicz; Bernard A. Maloney, both of Corpus Christi, Tex.

[73] Assignee: PPG Industries, Inc., Pittsburgh, Pa.

[21] Appl. No.: 678,561

[22] Filed: Apr. 20, 1976

[51] Int. Cl.[2] ..... C25B 13/06

[52] U.S. Cl. ..... 264/91; 162/155; 204/296; 264/104; 264/115; 264/127; 264/136; 264/257; 264/331

[58] Field of Search ..... 264/104, 103, 109, 115, 264/125–126, 127, 232, 233, 331, 136–137, 257, 91; 162/3, 153, 155; 204/296

[56] References Cited

U.S. PATENT DOCUMENTS

| | | | |
|---|---|---|---|
| 3,694,281 | 9/1972 | Leduc | 204/296 |
| 3,723,264 | 3/1973 | Leduc et al. | 204/295 |
| 3,853,721 | 12/1974 | Darlington et al. | 204/296 |
| 3,945,910 | 3/1976 | De Ceuster et al. | 204/296 |
| 3,980,613 | 9/1976 | Bachot et al. | 264/127 |

FOREIGN PATENT DOCUMENTS

| | | |
|---|---|---|
| 2,401,942 | 8/1974 | Germany. |

*Primary Examiner*—Jeffery R. Thurlow
*Attorney, Agent, or Firm*—Richard M. Goldman

[57] ABSTRACT

Disclosed is a method of preparing an asbestos diaphragm containing a thermoplastic resin. According to the method disclosed herein, an asbestos mat is prepared by drawing the asbestos mat from a salt free, aqueous, asbestos slurry, providing the resin, and thereafter heating the mat to form the resin reinforced mat.

5 Claims, No Drawings

METHOD OF PROVIDING A RESIN REINFORCED ASBESTOS DIAPHRAGM

DESCRIPTION OF THE INVENTION

Diaphragms are used in electrochemical processes to separate anolyte liquor from catholyte liquor while permitting the flow of electrolyte therethrough. Diaphragms are used, for example, to separate an oxidizing electrolyte from a reducing electrolyte, or a concentrated electrolyte from a dilute electrolyte, or a basic electrolyte from an acidic electrolyte. In chlor-alkali electrolysis the diaphragm separates an acidic anolyte liquor from a basic catholyte liquor. Most commonly, chlor-alkali cell diaphragms have been made of asbestos. Asbestos diaphragms are characterized by a short life, e.g., on the order of about six to eight months in chlor-alkali service. Attempts to extend the life of asbestos diaphragms while maintaining desirable electrical properties have included the use of various polymers and resins within the asbestos mat, for example, by codeposition of the polymer with the asbestos or by application of the polymer to the deposited asbestos and thereafter heating of the polymer-containing asbestos mat to a temperature sufficient to partially melt the polymer. The liquid polymer flows over the asbestos fibers, binding the asbestos fibers together with a polymer film.

The prior art teaches that the temperature to which the asbestos mat having resin or polymer dispersed therein is heated should be sufficient to cause the polymer to soften and flow but insufficient to lead to any significant degradation or decomposition of the polymeric material. See, for example, the discussion in German Offenlegungsschrift 2,401,942 based on U.S. application Ser. No. 324,508, filed Jan. 17, 1973, by Fenn et al for DIMENSIONALLY STABLE ASBESTOS DIAPHRAGMS, at page 7, line 26 to page 8, line 2 of the priority document. Additionally, in U.S. Pat. No. 3,723,264 to Leduc et al for ELECTROCHEMICAL OXIDATION OF OLEFINIC COMPOUNDS, the disclosed temperatures are only sufficient to melt a halocarbon resin.

In the prior art, the asbestos and the resin have been deposited from various solvents, for example, aqueous solvents such as water, aqueous cell liquor of sodium chloride and sodium hydroxide, aqueous sodium chloride, aqueous potassium hydroxide and potassium choride, and organic solvents.

It has now surprisingly been found that a particularly desirable asbestos diaphragm may be prepared having enhanced liquid permeability and electrical conductivity by drawing the asbestos fibers from an aqueous caustic soda slurry or an aqueous caustic potash slurry, i.e., a substantially chloride-freee aqueous slurry. According to one exemplification of this invention, the resin or polymer and the asbestos are slurried together in an aqueous alkali metal hydroxide solution whereby the polymer and the asbestos are codeposited. The asbestos mat containing the resin is heated above the temperature at which the resin begins to soften and flow whereby to form a diaphragm according to the method of this invention.

According to another exemplification of the method of this invention, the polymer is dispersed on the surface of an asbestos mat and the mat is then heated as described above. It is believed that the absence of salt in the slurry results in a more uniform deposition of the asbestos, as well as a more uniform flow of the polymer when molten, thereby enhancing the effect of the polymer. The resulting melted polymer provides a discontinuous polymeric coating over the asbestos fibers and fibriles, binding adjacent fibers and fibriles together.

DETAILED DESCRIPTION OF THE INVENTION

According to the invention, an improved thermoplastic resin-containing asbestos diaphragm is provided. This asbestos diaphragm contains a thermoplastic polymer. The polymer may either be a hydrocarbon or a halocarbon, i.e., a polymer containing both hydrogen and halogens. According to the method of this invention, the asbestos is drawn from a salt-free, aqueous alkali metal hydroxide slurry, the hydrocarbon-halocarbon resin is deposited in the asbestos or codeposited with the asbestos by methods well known in the prior art, and then the resin-containing asbestos diaphragm is heated for a time and to a temperature sufficient to cause the resin to flow.

As used herein, the word "asbestos" includes chrysotile asbestos, cristobalite asbestos, amphibole asbestos, and serpentine forms of asbestos. As used herein, the term "thermoplastic" as applied to the resin means those polymeric materials capable of being melted to form a liquid or a tacky solid without a significant amount of degradation and capable of thereafter being cooled to form a solid material. As used herein, a "discontinuous film" on the asbestos fibers is a film formed by a molten or liquid or tacky solid resin on individual asbestos fibers and fibriles after the cooling and solidification of the resin. As used herein, the term "salt-free" as applied to the slurry means an aqueous slurry containing asbestos, an alkali metal hydroxide, and less than about 2 weight percent alkali metal chloride.

The polymeric material used is not critical as long as the material used is thermoplastic and has some chemical resistance when used in combination with asbestos to nascent chlorine. Suitable resins may be hydrocarbons, halocarbons, or copolymers thereof.

The resin or polymer may be a hydrocarbon homopolymer, e.g., polyethylene, polypropylene, polyisobutylene, and polystyrene. Alternatively, the resin or polymer may be a hydrocarbon copolymer such as a copolymer of styrene and ethylene, or a copolymer of styrene and isobutylene, or a copolymer of ethylene and isobutylene.

Alternative resins may be hydrocarbon-halocarbon copolymers having repeating units of the formulae:

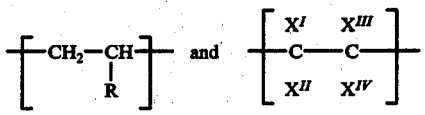

where R is hydrogen or a hydrocarbon group capable of being oxidized under the conditions normally encountered when wet asbestos is heated to a temperature above about 240° C. $X^{I}$, $X^{II}$, $X^{III}$, and $X^{IV}$ may be hydrogen, bromine, chlorine, or fluorine, but at least one of the X's must be a halogen. Typical halocarbon moieties useful in providing the halocarbon-hydrocarbon copolymer useful in this invention include vinyl fluoride, vinylidene fluoride, trifluoroethylene, perfluoroethylene, vinyl chloride, vinylidene chloride, and chlorotrifluoroethylene. Halocarbon moieties containing at least two halogen atoms are preferred, i.e., vinylidene chloride, vinylidene fluoride, trifluoroethylene, chlorotrifluoroethylene, and perfluoroethylene. Particularly preferred are trifluoroethylene, chlorotrifluoroethylene, and perfluoroethylene. The copolymer may be a graft copolymer, a block copolymer, an alternating copolymer, or a random copolymer. Copolymers having some degree of alternating character or of random character are preferred. One particularly outstanding halocarbon-hydrocarbon copolymer is Allied Chemical Corporation's HALAR (R) poly(ethylene-chlorotrifluoroethylene), an alternating copolymer of ethylene and chlorotrifluoroethylene, having a crystalline melting point of 245° C. and available as a pellet, powder, sheet, or fiber. Typically, the hydrocarbon moiety is ethylene, or butylene. Ethylene is preferred because of the lower cost of ethylene-containing polymers relative to propylene or butylene-containing polymers. When a copolymer is utilized, it is particularly important that a substantial amount, e.g., from at least about 20 to as much as 60 or even 80 mole percent or more of the copolymer be hydrocarbon, i.e., the addition polymerization product of an olefinic hydrocarbon, capable of being oxidized and degraded when heated to a temperature above the crystalline melting point thereof in the presence of asbestos. Amounts of hydrocarbon less than about 20 mole percent of the copolymer may provide a copolymer that is too resistant to degradation during the diaphragm formation process, requiring rigorous conditions, e.g., high amounts of metal ions in the asbestos in contact with the polymer, or high temperatures, or both.

According to another alternative exemplification of this invention, the polymer may be a homopolymer of an olefinic halocarbon having the empirical formula:

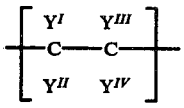

where $Y^{I}$ is a halogen chosen from the group consisting of fluorine, chlorine, and bromine, and preferably from the group consisting of fluorine and chlorine. $Y^{II}$, $Y^{III}$, and $Y^{IV}$ are chosen from the group consisting of fluorine, chlorine, bromine and hydrogen. One of the members $Y^{II}$, $Y^{III}$, $Y^{IV}$ may be hydrogen. Typical homopolymers contemplated in the method of this invention include polyvinyl chloride, polyvinylidene chloride, polytrichloroethylene, poly(1-chloro,-2,2-difluoroethylene), poly(1-chloro-1, 2-difluoroethylene), polytrifluoroethylene, polyvinyl fluoride, and polyvinylidene fluoride. When the amount of resin or polymer is low relative to the total amount of solids, e.g., 10 weight percent or less, the resin may be a strongly hydrophobic resin such as poly tetrafluoroethylene.

The amount of resin in the diaphragm is high enough to enhance the physical strength thereof but low enough to avoid the formation of a continuous surface or film on the anolyte facing surface of the diaphragm. Generally, the diaphragm of this invention will contain 0.2 weight percent resin to about 80 weight percent resin, basis total asbestos and resin. Preferably, the diaphragm of this invention will contain from about 1 weight percent resin to about 45 weight percent resin, basis total asbestos and resin.

According to a preferred method of this invention, after the asbestos and the resin have been found into a mat as described hereinafter, the mat is heated in the presence of air or oxygen to a temperature of about 20° to about 80° or even 120° above the crystalline melting point of the resin but below about 350° C. The temperature of the asbestos mat is maintained above the melting point of the resin but below about 350° C., for at least about 15 minutes and preferably for from about 45 to about 75 minutes. No ill effects are noted if the asbestos mat is maintained at an elevated temperature for a longer time. Thereafter, the asbestos mat is allowed to cool to a temperature below about 100° C., for example, 90° C. or 70° C. or even 25° C. or 20° C. During cooling the polymeric resin solidifies and puckers, resulting in openings and orifices, thereby providing a discontinuous hydrocarbon-halocarbon resin film on the surface of the asbestos mat, coating individual fibers and fibriles, and binding individual fibers and fibriles together.

According to an alternative method of this invention, an asbestos diaphragm may be prepared by depositing a non-woven, fibrous asbestos mat on a cathode from a salt-free solution. The resin may then be deposited on the diaphragm, e.g., on the surface of and within the diaphragm, as by spraying or brushing a liquid composition containing the resin on the surface of the diaphragm, or by drawing a liquid composition containing the resin into or through the diaphragm. The diaphragm is then heated above the crystalline melting point of the resin as described hereinabove.

According to a still further exemplification of this embodiment of the invention, the resin may be codeposited with the asbestos and thereafter resin may be deposited atop the mat of codeposited asbestos and resin. For example, a mat may be deposited containing from about 0.2 to about 0.4 pounds of asbestos per square foot with from about 0.01 to about 0.1 pounds of resin codeposited therewith and thereafter depositing from about 1.0 to about 10.0 grams of resin per square foot atop the codeposited resin and asbestos mat.

While this additional coating, film, or surface may be deposited prior to or subsequent to heating the asbestos, this further coating must itself be heated. According to this exemplification, a liquid composition containing the polymer may be brushed or sprayed onto the surface of the asbestos mat, depositing polymer particles on the surface thereof. Or, the polymer particles may be placed on the surface of or into a liquid composition, with the asbestos mat below the surface of the liquid and attached to a vacuum. The vacuum then draws the liquid through the asbestos mat, depositing the polymer particles on the surface of the mat. The mat may then be heated as described previously.

Typically, the amount of alkali metal hydroxide provided by drawing the asbestos from a slurry containing 10 moles per liter of alkali metal hydroxide and about 0.5 weight percent solids and thereafter drawing the water out of the deposited asbestos resin mat by pulling a vacuum for several minutes is enough to form a stoichiometric amount of sodium silicate and is to be avoided. Preferably, the asbestos is deposited from a solution having about two and one-half to about five moles of alkali metal hydroxide per liter, whereby the amount of alkali metal hydroxide ion present with the asbestos is low enough to avoid the complete formation of a monolayer or film of alkali metal silicate on the exposed areas of the asbestos during melting of the resin and the forming of the film.

When the asbestos and the hydrocarbon-halocarbon resin are drawn from an aqueous solution of sodium hydroxide, the solution will typically contain from about 10 to about 300 grams per liter and preferably from about 100 to about 180 grams per liter of the alkali metal hydroxide and less than 20 grams per liter of the alkali metal chloride. The alkali metal hydroxide may be potassium hydroxide or sodium hydroxide. Most commonly the alkali metal hydroxide is sodium hydroxide.

The slurry typically contains from about 0.1 to about 10.0 weight percent total solids, i.e., asbestos and resin, and preferably from about 0.1 to about 10.0 weight percent total solids. About 0.2 to about 80 weight percent of the solids are resin, and preferably from about 1 to about 20 weight percent of the solids are the resin, with the balance normally being asbestos.

The preferred polymer resins of this invention are substantially insoluble and at most only sparingly soluble in water and in aqueous solutions. It is therefore necessary to first provide a liquid composition, e.g., a suspension, containing from about 10 to about 500 grams per liter of the polymeric resin and from about 0.05 to about 10 grams per liter of the surfactant. This liquid composition of surfactant and polymeric resin is then added to the slurry from which the asbestos and resin are to be drawn onto the cathode. Typical surfactants useful in the method of this invention are those characterized by their ability to wet and disperse the polymer in aqueous solutions. The preferred surfactants are the non-ionic surfactants. One desirable non-ionic surfactant is duPont MERPOL(®) SE non-ionic surfactant, while a desirable non-ionic fluorocarbon surfactant is duPont ZONYL (®) FSN non-ionic fluorocarbon surfactant. The liquid composition containing the asbestos fibers and the polymeric resin is then drawn through the cathode or other foraminous support means, thereby depositing asbestos and the resin onto the cathode or support by methods well known in the prior art, e.g., by drawing a vacuum and thereby drawing the slurry through a foraminous or perforate surface, as a cathode, thereby depositing the asbestos and the resin thereon. The asbestos mat may then be heated without further treatment. Or, a film or surface layer or coating of the resin may be deposited on the surface of the mat and the mat then heated as described hereinabove. The mat may then be further treated to form sodium silicate on the uncoated surfaces of the asbestos fibers and fibriles as described hereinabove. Thereafter, the diaphragm may be installed in an electrolytic cell and electrolysis commenced.

EXAMPLE I

A resin impregnated asbestos mat was drawn from a salt-free sodium hydroxide slurry and utilized as the diaphragm in a chlor-alkali cell.

A slurry was prepared containing 15,300 grams of water, 1700 grams of sodium hydroxide, 280.5 grams of Quebec Asbestos Producers Association grade 4D-12 asbestos, and a liquid composition prepared from 31.2 grams of Allied Chemical Corporation HALAR(®) ethylene-chlorotrifluoroethylene copolymer, 0.6 cubic centimeters of Triton X-100 surfactants, and 31.2 grams of water. The slurry was placed in a five-gallon polyethylene bottle having a ½ inch polyvinylchloride pipe passing through a rubber stopper to the bottom of the bottle and a second pipe passing through the stopper but terminating above the level of slurry in the bottle. The second pipe was attached to a vacuum pump so that air could be drawn through the first pipe and up through the slurry. The slurry was agitated for 2 hours by drawing 7 to 8 liters of air per minute through the slurry.

The slurry was then poured into a slurry tank and deposited onto a cathode unit. The cathode unit was a 500 cubic centimeter capacity unit, fabricated of ten gauge steel sheet. The cathode was a 5 inch by 7 inch, 6 by 6 mesh to the inch, 3/16 inch, number 13 steel screen. The cathode unit was inserted into the slurry tank and the diaphragm deposited by applying a vacuum to the cathode unit. The vacuum was built up, in a step-wise fashion, to about 20 centimeters of mercury over a period of about 16 minutes. The cathode, still under vacuum, was lifted from the slurry tank and excess slurry was allowed to drain back into the slurry tank.

The cathode with the codeposited asbestos-resin mat thereon was placed in an oven preheated to 105° C. and maintained thereat for 16 hours. Thereafter, the temperature of the oven with the cathode therein was heated to 260° C. and maintained thereat for 2 hours.

The cathode units and anode units were then assembled to form laboratory electrolytic cells. The anode units, constructed to chlorinated polyvinyl chloride, had a capacity of 500 cubic centimeters. The anode, measuring 5 inches (12.5 centimeters) by 7 inches (17.5 centimeters) was 1/16 inch Grade-1 titanium mesh with a rethenium oxide coating. The anode and cathode units were assembled to provide a ¼inch anode to cathode gap.

After assembly, electrolysis was commenced with an aqueous sodium chloride feed. The current density was approximately 190 amperes per square foot and the feed rate was sufficient to provide approximately 50 percent salt decomposition at that current density.

The following results were obtained:

| Days on Line | Cell Volts | Cathode Current Efficiency (Percent) | Kilowatt Hours per Unit of $Cl_2$ and 2NaOH |
|---|---|---|---|
| 4 | 3.08 | 95.59 | 2207 |
| 11 | 3.09 | 91.97 | 2302 |
| 18 | 3.11 | 96.50 | 2208 |
| 25 | 3.09 | 95.33 | 2220 |
| 32 | 3.10 | 96.65 | 2197 |
| 39 | 3.08 | 93.49 | 2257 |
| 46 | 3.08 | 95.53 | 2209 |
| 53 | 3.11 | 93.76 | 2272 |

EXAMPLE II

A second diaphragm was prepared from the remainder of the slurry used in preparing the diaphragm of Example I. The diaphragm was deposited by the stepwise application of a vacuum of 20 centimeters of mercury over 8.5 minutes. The deposited diaphragm was then heated and dried as described in Example I.

Thereafter, the surface of the diaphragm was coated with a liquid composition prepared from 5.1 grams of Allied Chemical Corporation KYNAR(TM) RC 9332 polyvinylidene fluoride latex (24 percent nonvolatile matter) in 200 milliliters of 5 weight percent sodium hydroxide. The cathode was maintained under a vacuum of 25 centimeters of mercury for 20 minutes to draw the liquid through the cathode. It was then removed and placed in an oven maintained at a temperature of 100° C. for 4 hours. Thereafter, the oven was heated to 200° C. for 1 hour and then turned off.

The cathode, with the diaphragm thereon, was assembled with an anode unit as described in Example I and electrolysis was commenced. After 88 days of electrolysis at 190 amperes per square foot, the average cell voltage was 3.19 volts, the average cathode current efficiency was 97.31 percent, and the cathode kilowatt hours per unit of $Cl_2$ and 2NaOH was 2245 kilowatt hours per unit.

EXAMPLE III

Codeposited asbestos-resin diaphragms were drawn from salt-free sodium hydroxide slurries and tested as diaphragms in laboratory chloralkali cells.

Slurries were prepared by adding Quebec Asbestos Producers Association grade 4D-12 chrysotile asbestos to 10 weight percent solutions of sodium hydroxide. Thereafter, a dispersion of Allied Chemical Corporation HALAR(TM) copolymer of ethylene and chlorotrifluoroethylene with Triton X-100 surfactant in water was added to the slurry in sufficient quantity to provide a solids content (basis total weight of asbestos and resin) that was 10 weight percent resin and 90 weight percent asbestos. The slurry was agitated and then deposited on cathodes as described in Example I above. The resulting codeposited asbestos and resin mats were then heated to the temperatures and for the times indicated in Table I below.

The cathode units were assembled with anode units as described in Example I above and electrolysis was commenced at 190 amperes per square foot. The results shown in Table I were obtained.

TABLE I

| Run | A | B |
|---|---|---|
| Time of heating (hours) | 5.8 | 5.8 |
| Temperature (degrees C.) | 250–260 | 250–260 |
| Days on line | 194 | 196 |
| Average Cell Voltage (volts) | 3.13 | 3.09 |
| Cathode efficiency (%) | 96.13 | 95.33 |
| Kilowatt hours/unit | 2228 | 2226 |

EXAMPLE IV

A codeposited asbestos-resin diaphragm was drawn from a salt-free sodium hydroxide slurry and tested as a diaphragm in a laboratory chloralkali cell.

The slurry was prepared by adding Quebec Asbestos Producers Association grade 4D-12 chrysotile asbestos to a 10 weight percent solution of sodium hydroxide. Thereafter, a dispersion of Allied Chemical Corporation HALAR(TM), a copolymer of ethylene and chlorotrifluoroethylene, with duPont MERPOL(TM) SE surfactant in water was added to the slurry in sufficient quantity to provide a solids content (basis total weight of asbestos and resin) that was 10 weight percent resin and 90 weight percent asbestos. The slurry was agitated and then deposited on a cathode as described in Example I above. The resulting codeposited asbestos and resin mat was then heated to the temperature and for the time indicated in Table II below.

Thereafter a solution prepared from 5.1 grams of Allied Chemical Corporation KYNAR(TM) RC 9332 polyvinylidenefluoride in 200 milliliters of 5 weight percent sodium hydroxide was poured over the cathode and a vacuum was drawn within the cathode to pull the solution through. Thereafter, the cathode was heated. The vacuum, the time of heating, and the temperature are shown in Table II below. The cathode and an anode were then assembled to form a cell as described in Example I above. The results obtained are shown in Table II below.

TABLE II

| | |
|---|---|
| Time of first heating (hours) | 1 |

TABLE II-continued

| | |
|---|---|
| Temp. of first heating (° C.) | 265 |
| Vacuum (cm Hg) | 25 |
| Time of second deposition (hours) | 0.33 |
| Temp. of second heating (° C.) | 200 |
| Days on line | 97 |
| Average cell voltage (volts) | 3.20 |
| Cathode efficiency (%) | 97.36 |
| Kilowatt hours/unit | 2251 |

Although the method of this invention has been described and illustrated with respect to particular exemplifications and embodiments thereof, it is not intended to be so limited but is to only be limited as described in the appended claims.

We claim:

1. In a method of preparing an asbestos diaphragm containing a thermoplastic hydrophobic resin which method comprises forming a fibrous chrysotile asbestos mat having the resin therein and thereafter heating the mat to melt said resin, the improvement wherein said resin is capable of being oxidized and degraded when heated above the crystalline melting point thereof in the presence of asbestos, and which method comprises depositing said asbestos diaphragm from an aqueous slurry substantially free of alkali metal chloride and consisting essentially of from about 1 to about 30 weight alkali metal hydroxide and from about 0.1 to about 10 weight percent total asbestos and resin, wherein the resin is from about 0.2 to about 8 weight percent of the total asbestos and resin and wherein the resin is selected from the group consisting of:

A. hydrocarbon resins;

B. homopolymers having the empirical formula:

$$\{CY^{I}Y^{II}-CY^{III}Y^{IV}\};$$

and

C. copolymers having hydrocarbon and halocarbon moieties wherein the halocarbon moiety is chosen from the group consisting of halocarbons having the empirical formula:

$$\{CX^{I}X^{II}-CX^{III}X^{IV}\}$$

wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, and hydrogen, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of fluorine, chlorine, bromine, and hydrogen.

2. The method of claim 1 wherein the concentration of alkali metal chloride in the slurry is low enough to avoid crystallization of solid alkali metal chloride on the asbestos fibers.

3. The method of claim 1 wherein the alkali metal hydroxide is sodium hydroxide.

4. The method of claim 1 wherein the resin is a homopolymer chosen from the group consisting of polyvinyl chloride, polyvinylidene chloride, polytrichloroethylene, poly(1-chloro-2,2-difluoroethylene), poly(1-chloro,-12-difluoroethylene), polytrifluoroethylene, polyvinyl fluoride, poly(vinylidenefluoride), polyethylene, polypropylene, polyisobutylene, and polystyrene.

5. The method of claim 1 wherein the hydrophobic resin is a copolymer of a hydrocarbon and a halocarbon selected from the group consisting of perfluoroethylene, trifluoroethylene, vinylidene fluoride, vinylidene chloride, and chlorotrifluoroethylene.

* * * * *

Notice of Adverse Decision in Interference

In Interference No. 100,351, involving Patent No. 4,065,534, T. A. Rechlicz and B. A. Maloney, METHOD OF PROVIDING A RESIN REINFORCED ASBESTOS DIAPHRAGM, final judgment adverse to the patentees was rendered May 26, 1983, as to claims 1, 3, 4 and 5.

[*Official Gazette November 8, 1983.*]